United States Patent [19]

Shibata et al.

[11] Patent Number: 5,044,305

[45] Date of Patent: Sep. 3, 1991

[54] CURTAIN-TYPE COATING DEVICE

[75] Inventors: Norio Shibata; Tsunehiko Sato, both of Kanagawa, Japan

[73] Assignee: Fuji Photo Film Co., Ltd., Kanagawa, Japan

[21] Appl. No.: 597,273

[22] Filed: Oct. 16, 1990

Related U.S. Application Data

[63] Continuation of Ser. No. 363,571, Jun. 7, 1989, abandoned.

[30] Foreign Application Priority Data

Jun. 7, 1988 [JP] Japan ..... 63-138478

[51] Int. Cl.[5] ..... B05C 5/00; B05C 9/06

[52] U.S. Cl. ..... 118/73; 118/126; 118/314; 118/325; 118/412; 118/DIG. 4; 427/420

[58] Field of Search ..... 118/72, 73, 126, 300, 118/314, 325, 412, 413, DIG. 4; 427/420

[56] References Cited

U.S. PATENT DOCUMENTS

| | | | |
|---|---|---|---|
| 2,322,827 | 6/1943 | Carver | 118/DIG. 4 |
| 3,627,564 | 12/1971 | Mercier | 118/126 |
| 3,867,901 | 2/1975 | Greiller | 118/301 |
| 4,128,667 | 12/1978 | Timson | 118/DIG. 4 |
| 4,165,211 | 8/1979 | Ebeling et al. | 118/DIG. 4 |
| 4,230,743 | 10/1980 | Nakamura et al. | 427/420 |
| 4,287,240 | 9/1981 | O'Connor | 427/420 |
| 4,842,900 | 6/1989 | Miyamoto | 427/420 |

FOREIGN PATENT DOCUMENTS

| | | | |
|---|---|---|---|
| 53-21904 | 2/1978 | Japan | 427/420 |

*Primary Examiner*—James C. Housel

*Attorney, Agent, or Firm*—Sughrue, Mion, Zinn, Macpeak & Seas

[57] ABSTRACT

A curtain-type coating device including a coating head for applying a coating solution dropping in the form of a curtain from said coating head under force of gravity and which collides against the surface of a moving support to form a film layer on the support and a blade for guiding the curtain. A front edge of the blade is laid over a meeting line where the curtain meets the surface of the support in such a manner as to allow the passage of a film layer which has been formed on the support in advance.

5 Claims, 4 Drawing Sheets

CURTAIN-TYPE COATING DEVICE

This is a Continuation of Application Ser. No. 07/363,571 filed June 7, 1989, now abandoned.

BACKGROUND OF THE INVENTION

The present invention relates to a coating device, and more particularly to an improvement of a curtain-type coating device with which a curtain of a coating solution is allowed to drop onto a moving support under the force of gravity.

Various coating devices of different constructions used to coat supports with chloridic coating solutions have been extensively employed for manufacture of industrial products. The coating solutions may include magnetic coating solutions, photographic photosensitive coating solutions, pressure-sensitive coating solutions, and heat-sensitive coating solutions.

The term "support" as used herein is not particularly limited; however, it is intended to refer to flexible belt-shaped materials such as plastic films made of polyethylene terephthalate, polyethylene-2, 6-naphthalate, cellulose diacetate, cellulose triacetate, cellulose acetate propionate, polyvinyl chloride, polyvinylidene chloride, polycarbonate, polyimide, or polyamide; sheets of paper; sheets of paper on which $\alpha$-polyolefins two to ten in the number of carbon atoms, such as polyethylene, polypropylene, ethylene-butane copolymer, are coated or applied in laminated form; metal foils such as aluminum, copper or tin foils; and belt-shaped materials prepared by forming a preliminary layer or layers on the above-described flexible belt-shaped materials. Typical products are photographic films, photographic printing papers, magnetic tapes, and magnetic discs.

There are available a variety of methods for applying the above-described coating solutions. The coating method the invention concerns is the so-called "curtain-type coating method". FIGS. 5 and 6 show examples of the overall arrangement of a coating device for practicing a curtain-type coating method.

In the coating device shown in FIG. 5, a coating head 6 is arranged above a support 4 which is run at a predetermined speed with the coating head covering substantially the entire width of the support 4. The coating head 6 has a solution pool 2 which extends longitudinally of the head 6 (i.e., in the direction of width of the support), and a slit 3 communicated with the solution pool 2. The slit 3 opens upward. A coating solution 1 is supplied into the solution pool 2 by a coating solution supplying system (not shown). The coating solution 1 thus supplied is caused to flow through the slit 3 to the upper surface of the coating head 6, and allowed to drop substantially in the form of a curtain onto the surface of the support 4, thus forming a layer of the coating solution.

In the coating device shown in FIG. 6, the coating head 6 faces downward so that the coating solution 1 emerging from zs the slit 3 is allowed to drop onto the support 4.

The above-described curtain-type coating method suffers from a difficulty that air may rise between the coating solution 1 and the support 4. More specifically, as shown in FIG. 7, when the coating solution 1 collides against the moving s support 4, the position of the collision, namely, the meeting point 5 where the front end of the curtain of coating solution 1 meets the support 4, is shifted in the direction of conveyance of the support 4, and at the same time air 7, being pulled by the support 4, is forced into the layer of coating solution formed on the support 4, thus forming defects 8 therein.

The severity of this difficulty increases as either the coating speed is increased or the thickness of the coated film is decreased, thus causing a serious problem which obstructs not only increasing the range of thicknesses allowable for the coated film, but also improvements in the productivity thereof.

SUMMARY OF THE INVENTION

Accordingly, an object of the present invention is to eliminate the above-described difficulties accompanying a conventional curtain-type coating device. More specifically, an object of the invention is to provide a curtain-type coating device which results in an increase in the range of thickness achievable for a coated film and an improvement in productivity.

The foregoing and other objects of the invention have been achieved by the provision of a curtain-type coating device in which a coating solution dropping in the form of a curtain from a coating head collides against the surface of a moving support thus forming a film layer thereon, in which, according to the invention, the coating solution in the form of a curtain is guided to the support with a blade whose front edge is laid over a meeting line where the coating solution in the form of a curtain meets the surface of the support in such a manner as to allow the passage of a film layer which has been formed on the support in advance.

DESCRIPTION OF THE PREFERRED EMBODIMENTS

A preferred embodiment of the invention will be described with reference to the accompanying drawings.

Figure 1:
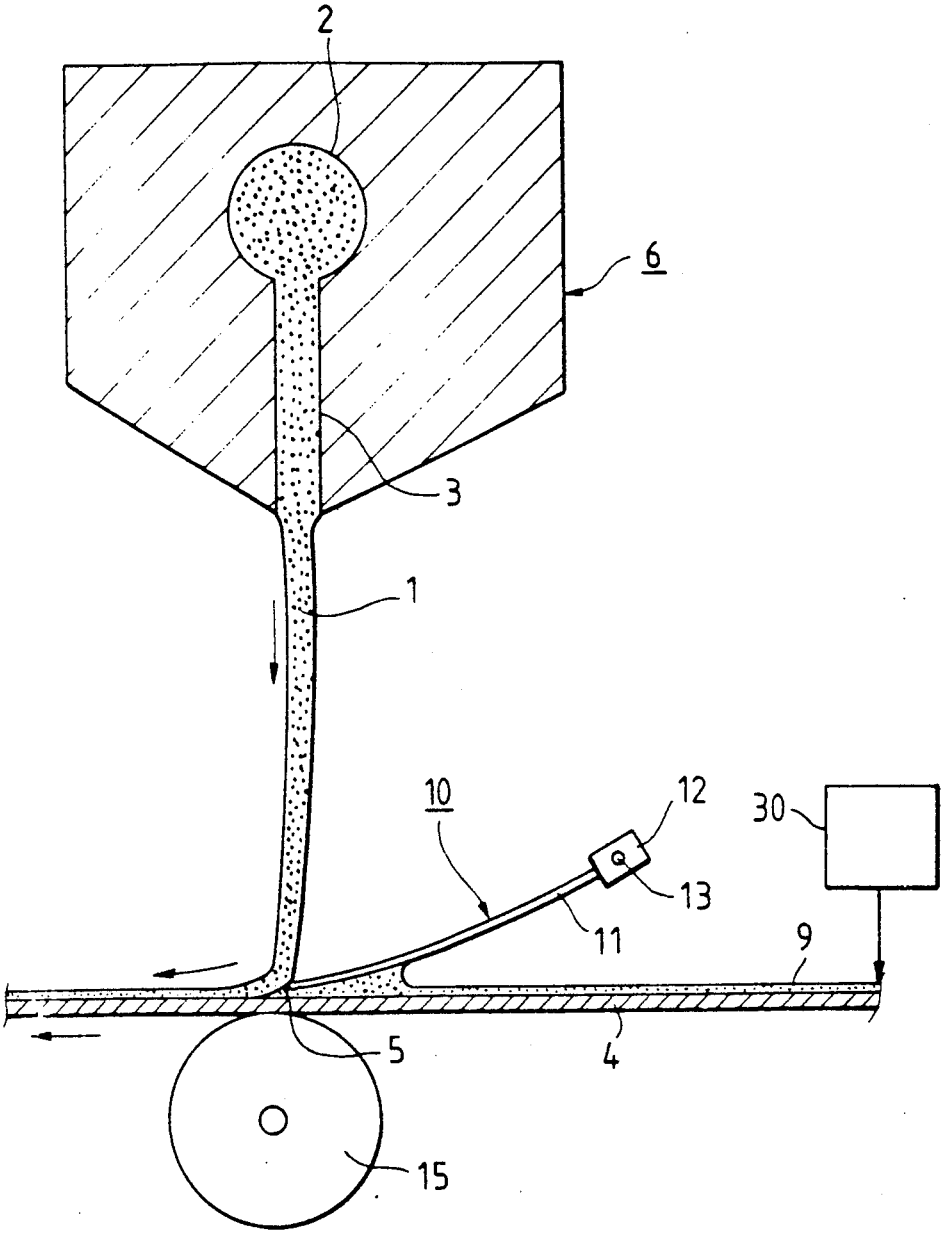
FIG. 1 is a sectional view depicting a coating device constructed according to the present invention.

As shown in FIG. 1, a coating head 6 has a slit 3 through s which a flow of a coating solution 1 emerges. The slit 3 extends downward to confront a moving support 4. Thus, the coating head 6 is substantially equal in construction to the conventional head. The coating solution 1 flowing out through the slit 3 is allowed to drop in the form of a curtain. A blade 10 is positioned below the coating head 6 and upstream of the curtain of coating solution 1 in the direction of movement of the support 4.

The blade 10 is made up of a flexible plate 11 of plastic or metal whose free end extends along the meeting line 5 where the curtain of coating solution 1 meets the support 4, and a holder 12 holding the flexible plate 11. The holder 12 is supported by a supporting shaft 13 which extends in the direction of width of the support 4. Thus, the position of the free end of the flexible plate 11 can be changed by turning or moving the supporting shaft 13.

In the region of the meeting line 5, a backup roller 15 is provided under the support 4 so that the support 4 is stably run in the coating-solution applying region. The backup roller 15 is provided only if necessary, and may be omitted in.some cases.

A coating-solution applying operation with the coating device thus constructed will be described.

The coating solution supplied to the solution pool 2 in the coating head is caused to flow out of the slit 3 and to drop in the form of a curtain vertically downward to meet the support 4. The front end (or free end) of the flexible plate 11 is laid over the meeting line 5 where the front end of the curtain of coating solution 1 meets the support 4.

A pre-coated layer 9 has been formed by a coating device 30 on the support 4 before the coating solution 1 is applied thereto. The precoated layer 9 is provided to allow the application of the coating solution 1 at high speed to form a thin film on the support. Therefore, it is lower in viscosity than the coating solution 1 and is soluble with the latter. Thus, it may be a solvent for the coating solution 1.

The flexible plate 11 allows the passage of the precoated layer 9 in such a manner as to catch part of the precoated layer 9 under it, so that it is held not in contact with the support 4. With respect to the liquid pressure of the precoated layer 9, the flexibility of the flexible plate works suitably. Thus, the curtain of coating solution 1 is led to the free end of the flexible plate 11 to meet the pre-coated layer 9. In this operation, the air accompanying the support 4 is removed by the flexible plate 11 and the pre-coated layer 9. Therefore, the behavior of the coating solution 1 is stable at the meeting line 5, and the entrance of the air into the coating solution can be effectively prevented. As a result, the coating speed can be greatly increased, making it possible to decrease the thickness of the film being formed.

In the embodiment shown in FIG. 1, a single film layer is formed; however, the technical concept of the invention is equally applied to the case where a plurality of film layers are formed on the support. The coating device for practicing the coating method of the invention is not always limited to what is shown in FIG. 1; that is, it may be modified, for instance, as shown in FIG. 2.

Figure 2:
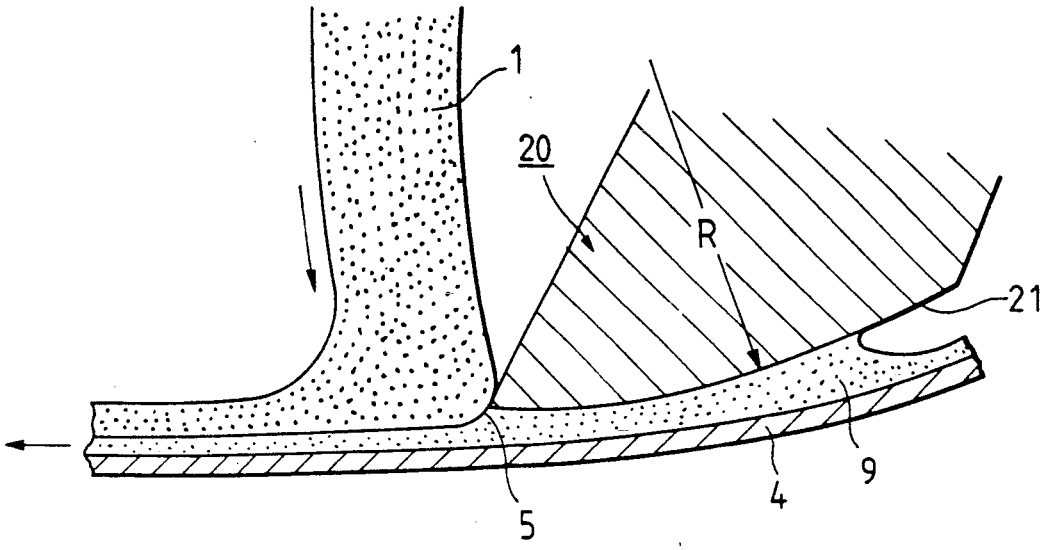
FIG. 2 is an enlarged sectional view showing one modification of a blade employed in the device of the invention.

FIG. 2 shows the end portion of a blade 20 which is made of a relatively rigid material. The blade 20 has a contact surface 21 which is brought into contact with the pre-coated layer 9. The contact surface 21 is curved with a radius of curvature R so that it is suitably brought into contact with the pre-coated layer 9. That is, the blade 20 is so designed that it can depress the support 4 with a suitable force, thus serving as a guide for the support 4.

As described above, in the coating device of the invention, with the blade whose edge is laid over the meeting line where the curtain of coating solution flowing out of the coating head meets the support, the curtain of coating solution is led to the support at the meeting line, and the air accompanying the support is completely removed through the synergetic effect of the blade and the pre-coated layer immediately before reaching the meeting line. Thus, the entrance of air into the film layer formed is completely prevented, and in addition not only can the coating speed be increased, but also the thickness of the film layer can be decreased.

As conducive to a full understanding of this invention, a specific example thereof using a magnetic coating solution will be described.

EXAMPLE OF THE INVENTION:

The materials listed in the following Table 1 were mixed and dispersed sufficiently (fifteen hours) in a ball mill to prepare a magnetic coating solution.

TABLE 1

| | |
|---|---|
| $\gamma$-$Fe_2O_3$ (coercive force = 320 Oe ($S_{BET}$ = 28 $m^2/g$) | 90 parts by weight |
| Polyurethane (trade name "Nipporan 2304") | 20 parts by weight |
| Polyisocyanate | 9 parts by weight |
| Carbon black | 2 parts by weight |
| Myristic acid | 1 part by weight |
| Cyclohexanone | 300 parts by weight |

The magnetic coating solution thus prepared was measured with the "Shimadzu Rheo-meter RM-1" manufactured by Shimadzu Corporation. By measurement it was determined that the coefficient of viscosity was 1.8 poise at a shear speed of 700 $sec^{-1}$.

Figure 3:
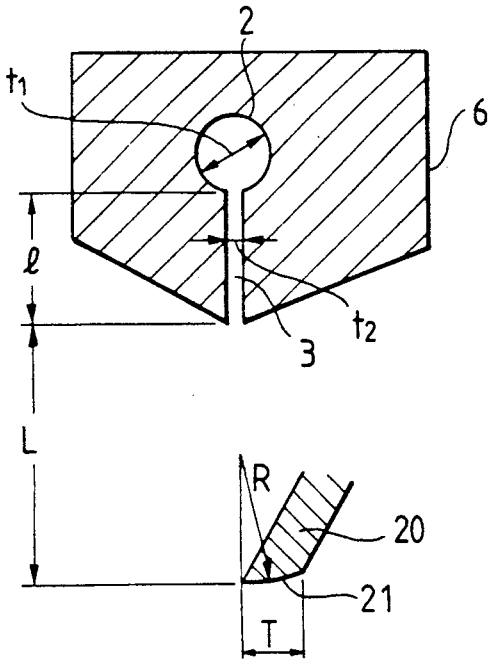
FIG. 3 is an explanatory diagram outlining essential parts of a coating head and blade employed in a specific example of the invention.

The coating solution prepared according to Table 1 was applied under the following coating conditions:

1.
Support
Material——polyethylene terephthalate film
Thickness——15 $\mu$m
Width——500 mm
Tension——10 kg/m
Support running speed——100 to 300 m/min
2.
Pre-coated layer
Solution——Cyclohexanone
Thickness——Wet thickness 2.0 $\mu$m
3.
Coating head and blade A single film layer was formed by using a coating head (6) and blade (20) as shown in FIG. 3. The inside diameter $t_1$ of the solution pool 2 was 25 mm, the width $t_2$ of the slit 3 was 0.8 mm, and the distance l between the solution pool and the outlet of the slit was 70 mm. The blade 20 was made of SUS 304, and the radius of curvature R of its contact surface 21 was 50 mm. The width T of the blade was 30 mm.

The distance L between the outlet of the slit and the end of the blade was 140 mm.

Figure 4:
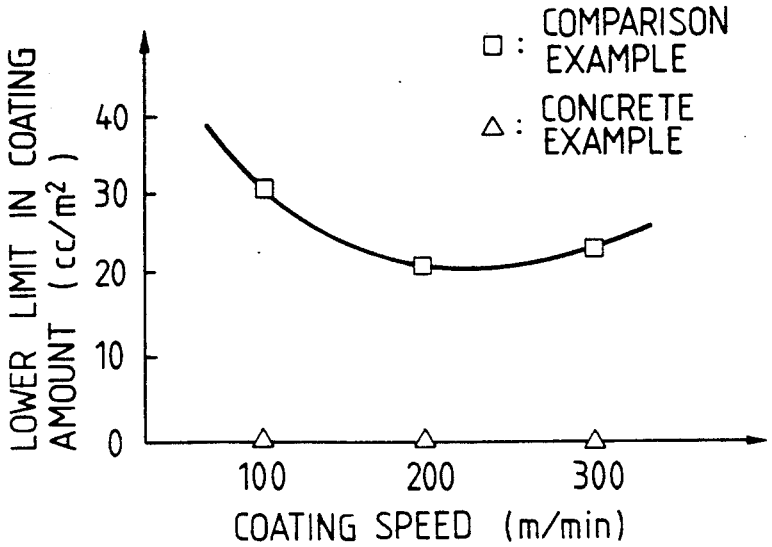
FIG. 4 is a graphical representation for comparison of the specific example of the invention with a comparison example thereof.
Figure 5:
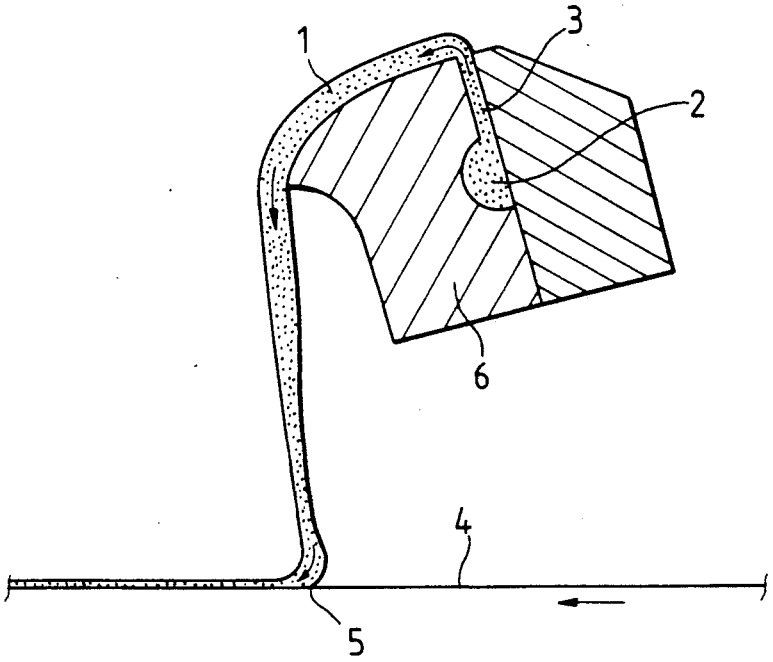
FIGS. 5 and 6 are explanatory diagrams showing examples of a conventional curtain-type coating device.
Figure 6:
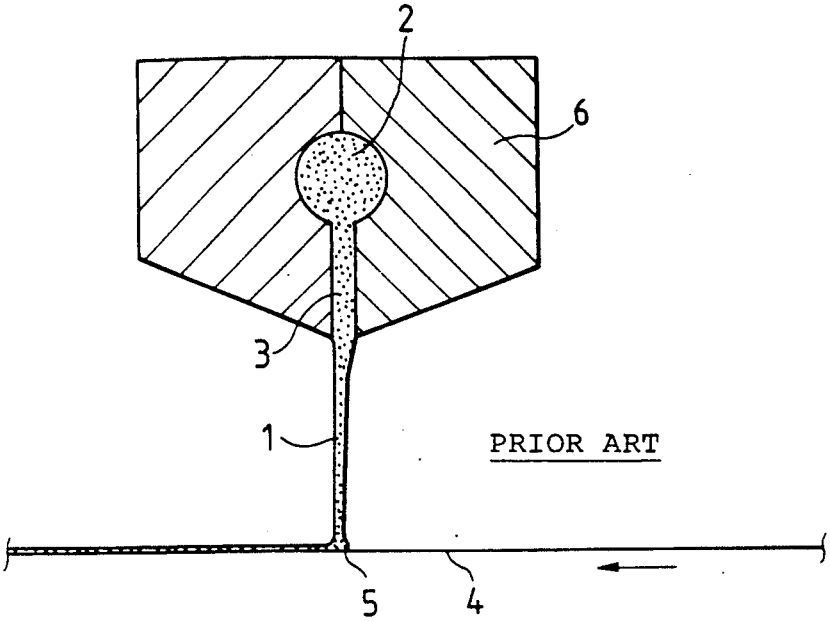
Figure 7:
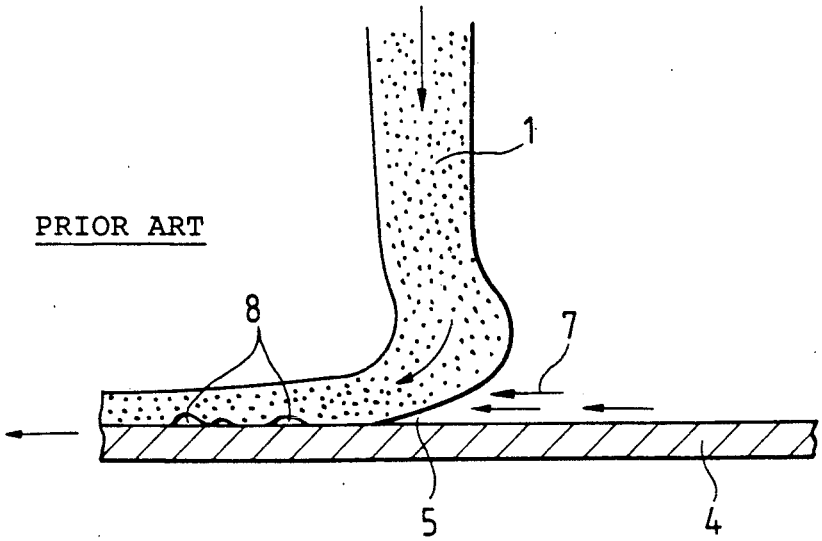
FIG. 7 is an explanatory diagram for a description of the formation of defects in a film layer formed on the support.

The results of the coating operation carried out under the above-described conditions are as shown in FIG. 4, which is a graphical representation indicating coating speeds with minimum amounts of coating. In FIG. 4, the results obtained with the above example of the invention are indicated with the mark "Δ".

As a comparison example, a coating operation was carried out under the above-described coating conditions for the example of the invention, but with the pre-coated layer and the blade eliminated. The results are as indicated by the marks "□" in FIG. 4.

As is seen from FIG. 4, with the comparison example the lower limit on the coating amount depends on the coating speed. The minimum coating amount of about 20 $cc/m^2$ is obtained for a coating speed about 200 m/min. On the other hand, for the example of the invention, the minimum amount of coating is substantially 0 cc/m$^2$. Moreover, the minimum amount of coating is substantially independent of the coating speed; that is, according to the invention, in forming a film layer the range of coating thickness obtainable is greatly increased.

What is claimed is:

1. A coating device for forming a film layer on a moving support, comprising: means for pre-coating said moving substrate with a liquid solvent; a supply of a coating solution which is soluble with said solvent of said pre-coated layer and which has a greater viscosity than said solvent; said coating solution dropping in the form of a curtain from said coating head under force of gravity and which collides against said one surface of said moving support to form said film layer on the support; and a blade for guiding said curtain, said blade being disposed entirely upstream of said curtain with respect to a direction of conveyance of said support, a front edge of said blade being laid over and simultaneously contacting both said curtain and said pre-coated layer only at a meeting line where said curtain meets said pre-coated layer on said one surface of said support without said front edge contacting said support, and in such a manner as to catch a part of said pre-coated layer but allow the passage of remaining portions of said pre-coated layer, whereby entrance of air into said film layer is prevented.

2. The curtain-type coating device of claim 1, wherein said blade comprises a flexible plate having a free end extending along said meeting line.

3. The coating device of claim 2, wherein said blade further comprises a holder for holding said flexible plate and a supporting shaft for supporting said holder.

4. The coating device of claim 1, further comprising a back-up roller disposed under said support below said meeting line.

5. The coating device of claim 1, wherein said blade comprises a rigid member having a curved end portion contacting said solvent layer.

* * * * *